US007243829B2

(12) United States Patent
Oda et al.

(10) Patent No.: US 7,243,829 B2
(45) Date of Patent: Jul. 17, 2007

(54) COMBUSTION POWER TOOL

(75) Inventors: Jiro Oda, Anjo (JP); Kenichi Miyata, Anjo (JP); Masanori Furusawa, Anjo (JP)

(73) Assignee: Makita Corporation, Anjo-chi (JP)

( * ) Notice: Subject to any disclaimer, the term of this patent is extended or adjusted under 35 U.S.C. 154(b) by 20 days.

(21) Appl. No.: 10/859,001

(22) Filed: Jun. 2, 2004

(65) Prior Publication Data

US 2004/0238588 A1 Dec. 2, 2004

(30) Foreign Application Priority Data

Jun. 2, 2003 (JP) ..... 2003-156585
Jun. 2, 2003 (JP) ..... 2003-156643
Jul. 24, 2003 (JP) ..... 2003-201111

(51) Int. Cl.
*B25C 1/08* (2006.01)
*B25C 1/18* (2006.01)
*B25C 1/16* (2006.01)

(52) U.S. Cl. ..... 227/9; 227/10; 227/130; 123/46 SC

(58) Field of Classification Search ..... 227/8, 227/9, 10, 130; 123/46 R, 46 H, 46 SC
See application file for complete search history.

(56) References Cited

U.S. PATENT DOCUMENTS 4,377,991 A * 3/1983 Liesse ..... 123/46 SC
4,403,722 A 9/1983 Nikolich
4,483,473 A * 11/1984 Wagdy ..... 227/8
4,712,379 A * 12/1987 Adams et al. ..... 60/632
4,721,240 A * 1/1988 Cotta ..... 227/10
4,773,581 A 9/1988 Ohtsu et al.
4,913,331 A * 4/1990 Utsumi et al. ..... 227/10
5,090,606 A * 2/1992 Torii et al. ..... 227/10
5,181,495 A 1/1993 Gschwend et al.
5,199,626 A * 4/1993 Terayama et al. ..... 227/10
6,260,519 B1 * 7/2001 Phillips ..... 123/46 R
6,520,127 B1 * 2/2003 Thieleke et al. ..... 123/46 R

FOREIGN PATENT DOCUMENTS

JP 63-74579 4/1988

OTHER PUBLICATIONS

European Search Report for Application No. 04012746.6-1262, dated Sep. 21, 2006.

* cited by examiner

*Primary Examiner*—Louis K. Huynh
*Assistant Examiner*—Nathaniel Chukwurah
(74) *Attorney, Agent, or Firm*—Lahive & Cockfield, LLP; Anthony A. Laurentano, Esq.

(57) ABSTRACT

A combustion power tool having a first combustion chamber, a second combustion chamber, an igniter, a partition, and a driving mechanism. Flammable gas is introduced or charged into the first and second combustion chamber. The igniter is disposed in the first combustion chamber. The partition separates the first combustion chamber from the second combustion chamber. Communication holes are formed in the partition at different angles with respect to the longitudinal direction of the first combustion chamber. The communication holes communicate the first combustion chamber with the second combustion chamber. The driving mechanism performs a predetermined processing work by utilizing an explosive combustion pressure. The combustion pressure is generated when flammable gas in the first combustion chamber is explosively burned by the igniter and when the burning front of the flammable gas in the first combustion chamber propagates to the second combustion chamber via the communication holes of the partition thereby explosively burning flammable gas in the second combustion chamber.

26 Claims, 12 Drawing Sheets

COMBUSTION POWER TOOL

BACKGROUND OF THE INVENTION

1. Field of the Invention

The present invention relates to a power tool such as a nailing machine, and more particularly, to a combustion power tool that performs a predetermined processing work by utilizing a high pressure impact force generated upon explosive combustion of flammable gas.

2. Description of the Related Art

Japanese Patent Publication Nos. 1-34753 (D1) and 5-55278 (D2) disclose an example of a combustion power tool. The known power tool is powered by a piston/cylinder-type internal combustion engine. In the reference D1, a fan is disposed within a combustion chamber where a combustion gas is burned. The fan serves to facilitate mixture of fuel and air and diffusion of the mixture within the combustion chamber, thereby expediting combustion. On the other hand, in the reference D2, a plurality of combustion chambers are provided and divided by partitions that have lattice-like communication holes. Each of the combustion chambers has a fuel injection hole, such that fuel and air can be efficiently mixed in each of the combustion chambers and the mixture can be efficiently diffused within the combustion chamber.

According to the reference D1, because the rotary fan is disposed within the combustion chamber, the mechanism of the power tool is complicated. According to the reference D2, although a technique for efficiently generating and diffusing the mixture within each of the combustion chambers is disclosed, further improvements are desired in order to improve the combustion efficiency of the mixture and to simplify the exhaust system for the combustion gas.

SUMMARY OF THE INVENTION

Accordingly, it is an object of the present invention to provide a technique for further improving the combustion process of a mixture in the combustion power tool.

According to one aspect of the present invention, a representative combustion power tool may comprise a first combustion chamber and a second combustion chamber, an igniter, a partition and a driving mechanism. Into the first and second combustion chamber, flammable gas is charged. The igniter is disposed in the first combustion chamber. The partition separates the first combustion chamber from the second combustion chamber. Communication holes are formed in the partition at different angles with respect to the longitudinal direction of the first combustion chamber. The communication holes communicate the first combustion chamber with the second combustion chamber. The driving mechanism performs a predetermined processing work such like a nailing work by utilizing a explosive combustion pressure. The combustion pressure is generated when flammable gas in the first combustion chamber is explosively burned by the igniter and when the burning front of the flammable gas in the first combustion chamber propagates to the second combustion chamber via the communication holes of the partition thereby explosively burning flammable gas in the second combustion chamber.

When the flammable gas in the first combustion chamber is burned, the burning front (burning surface) in the first combustion chamber is provided to reach each of the communication holes substantially at the same time. Therefore, flammable gas filled in the second combustion chamber can simultaneously and evenly be ignited by starting from the entire surface region of the partition. Thus, the combustion energy within the second combustion chamber can be evenly transferred to the driving mechanism. In other words, the flammable gas in the second combustion chamber starts burning almost simultaneously through the communication holes of the partition, so that the combustion controllability and the combustion efficiency within the second combustion chamber can be improved.

As another aspect of the present invention, the combustion chamber of the representative power tool may have an inner wall surface that is opposed to the driving mechanism and the igniter may be disposed in the inner wall surface. The inner wall may have a concave portion that curves radially outward from its central region to its circumferential edge portion in a direction toward the driving mechanism. In other words, the concave portion of the inner wall surface may be formed such that its circumferential edge portion is nearer to the driving mechanism than its central region. Namely, the distance between the inner wall surface and the driving mechanism is gradually shortened toward the circumferential edge portion. With such construction, when the flammable gas is burned by the igniter, the burning front of the flammable gas is smoothly guided along the concave portion of the inner wall surface from the deepest side (remotest region from the driving mechanism) of the concave portion of the inner wall surface in which the igniter is disposed, toward the driving mechanism. Therefore, the burning front or the combustion pressure of the flammable gas in the combustion chamber can be efficiently led toward the driving mechanism, so that the combustion efficiency in the combustion chamber can be improved.

Further, as another aspect of the present invention, the partition between the first and second combustion chambers may be provided to move to the second combustion chamber to reduce the capacity of the second combustion chamber. With such construction, the combustion gas that has already burned in the second combustion chamber may be introduced into the first combustion chamber when the partition is moved to the second combustion chamber as the capacity of the second combustion chamber is reduced. Thus, the combustion gas within the second combustion chamber can smoothly be discharged to the outside together with the combustion gas within the first combustion chamber.

Other objects, features and advantages of the present invention will be readily understood after reading the following detailed description together with the accompanying drawings and the claims.

DETAILED DESCRIPTION OF THE REPRESENTATIVE EMBODIMENT

Each of the additional features and method steps disclosed above and below may be utilized separately or in conjunction with other features and method steps to provide improved combustion power tool and method for using such power tool and devices utilized therein. Representative examples of the present invention, which examples utilized many of these additional features and method steps in conjunction, will now be described in detail with reference to the drawings. This detailed description is merely intended to teach a person skilled in the art further details for practicing preferred aspects of the present teachings and is not intended to limit the scope of the invention. Only the claims define the scope of the claimed invention. Therefore, combinations of features and steps disclosed within the following detailed description may not be necessary to practice the invention in the broadest sense, and are instead taught merely to particularly describe some representative examples of the invention, which detailed description will now be given with reference to the accompanying drawings.

FIRST REPRESENTATIVE EMBODIMENT OF THE INVENTION

Figure 1:
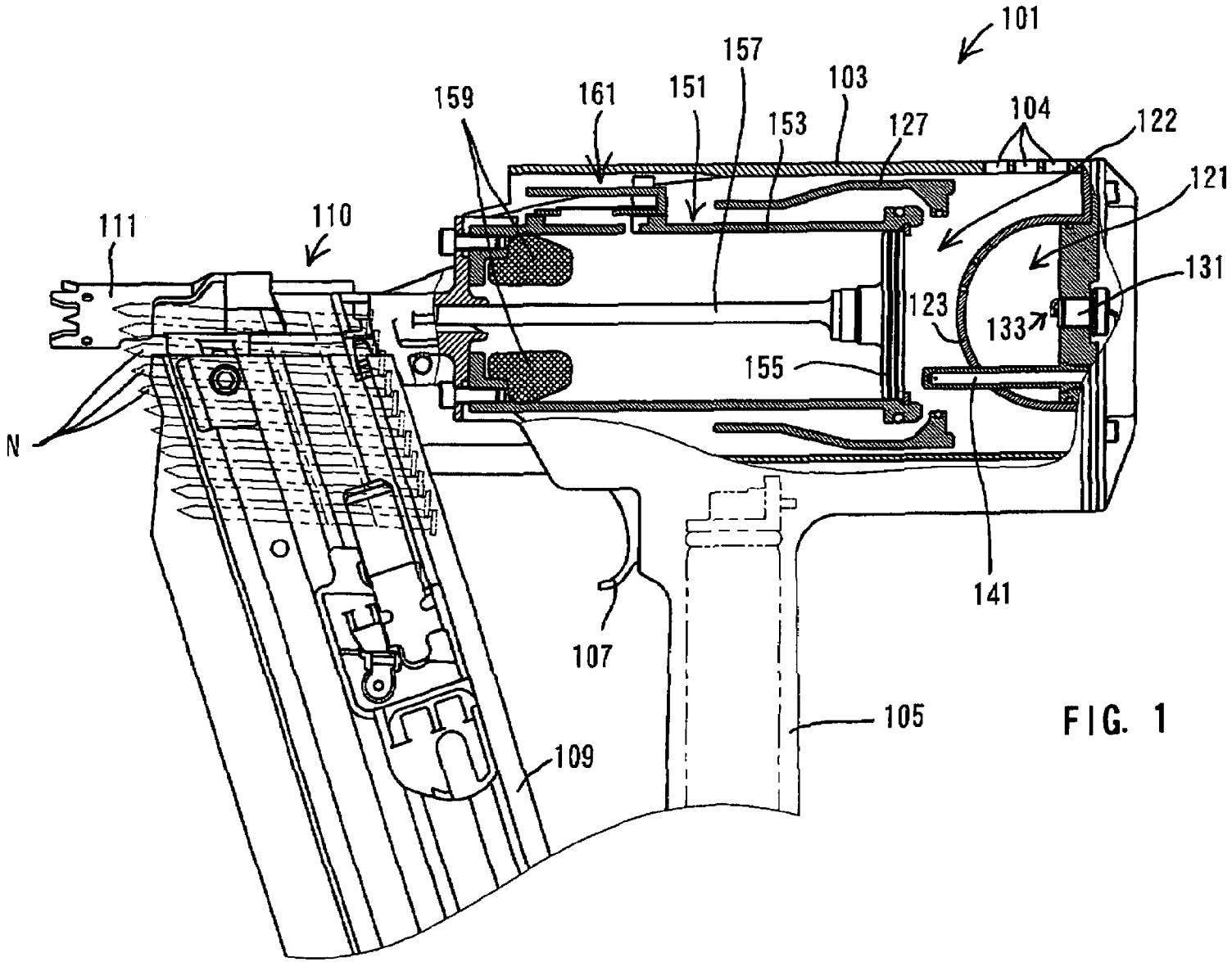
FIG. 1 is a front view, partly in section, showing an entire nailing machine according to the first representative embodiment of the invention.

First representative embodiment of the present invention will now be described with reference to the drawings. As shown in FIG. 1, a nailing machine 101 as a representative embodiment of the combustion power tool according to the present invention comprises a main housing 103, a nail ejection part 110, a handgrip 105 and a magazine 109. The main housing 103 houses a first combustion chamber 121, a second combustion chamber 122, an igniter 131, a fuel injector 141 and a driving mechanism 151. Bleed holes 104 are formed in the main housing 103 near the first combustion chamber 121 and the second combustion chamber 122. The first and the second combustion chambers 121, 122 can communicate with the outside through the bleed holes 104.

Figure 2:
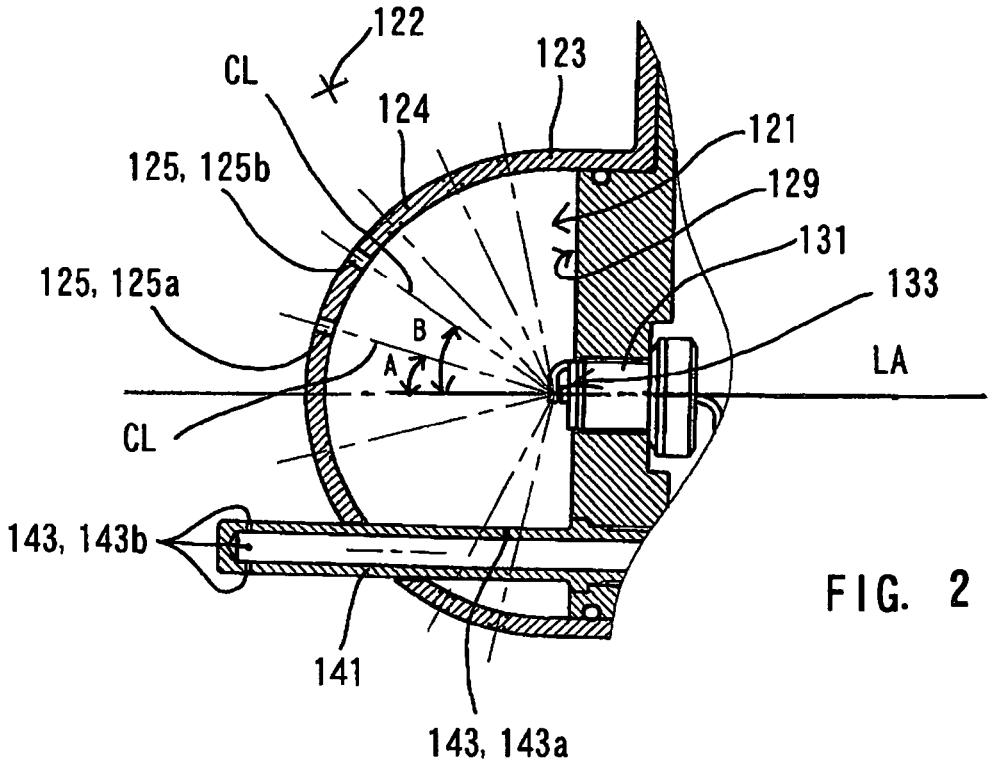
FIG. 2 is a detailed front view of FIG. 1 showing a partition that separates a first combustion chamber from a second combustion chamber according to the first embodiment.

As shown in FIG. 2, the first combustion chamber 121 is defined by a partition 123 and a flat end wall surface 129. The partition 123 separates the first combustion chamber 121 from the second combustion chamber 122 and the end wall surface 129 is located on the opposite side of the second combustion chamber 122. The first combustion chamber 121 defines an area for igniting a mixture, which will be described below, while the second combustion chamber 122 defines an area for obtaining high combustion energy required for a nailing operation.

The partition 123 comprises a spherical portion 124. The spherical portion 124 has a hemispherical shape with its center on an ignition part 133 of the igniter 131. The spherical portion 124 has generally the same sectional area as at least one of the end regions (designated by 122R and 122L in FIG. 5) of the second combustion chamber 122.

Figure 3:
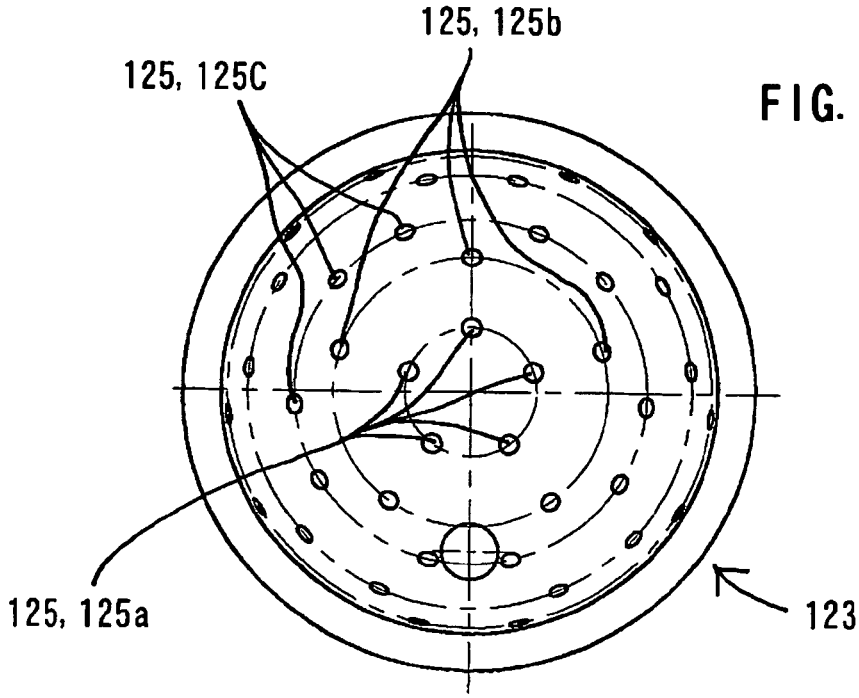
FIG. 3 is a left side view of FIG. 1 showing a plurality of communication holes formed in the partition.

Numerous communication holes 125 are formed through the spherical portion 124. The first combustion chamber 121 communicates with the second combustion chamber 122 via the communication holes 125. As shown in FIG. 3, which shows the partition 123 as viewed from the side of the second combustion chamber 122, the communication holes 125 are divided into a plurality of concentrically arranged groups 125*a*, 125*b*, 125*c* . . . . The communication holes 125 which are located nearer to the circumferential edge of the partition 123 have a larger opening diameter (area), in order to achieve sufficient combustion even in the circumferential edge region of the first and the second combustion chambers 121, 122. Further, in this embodiment, in order to improve combustion efficiency, the total opening area of the communication holes 125 per unit volume of the first combustion chamber 121 is about 2 to 4 $mm^2/cc$.

Further, as shown in FIG. 2, the communication holes 125 of the first group 125*a* are located at an angle A with respect to a longitudinal axis LA of the first combustion chamber 121. The communication holes 125 of the second group 125*b* are located at an angle B larger than the angle A with respect to the longitudinal axis LA of the first combustion chamber 121. Thus, the angles of the communication holes 125 of the groups 125*a*, 125*b*, 125*c* . . . with respect to the longitudinal axis LA increase in this order. In other words, the communication holes 125 of each group are formed in the partition 123 at a different angle from those of the other groups with respect to the longitudinal axis LA. Thus, the communication holes 125 are systematically arranged over the partition 123 from its central side to its circumferential edge side. The first and the second combustion chambers 121, 122 communicate with each other via the communication holes 125. In this embodiment, although it is not shown, the longitudinal axis LA of the first combustion chamber 121 coincides with the longitudinal axes of the second combustion chamber 122 and the nailing machine 101.

Further, in this embodiment, a central line CL of each of the communication holes 125 of any group extends toward the ignition part 133 of the igniter 131.

Figure 4:
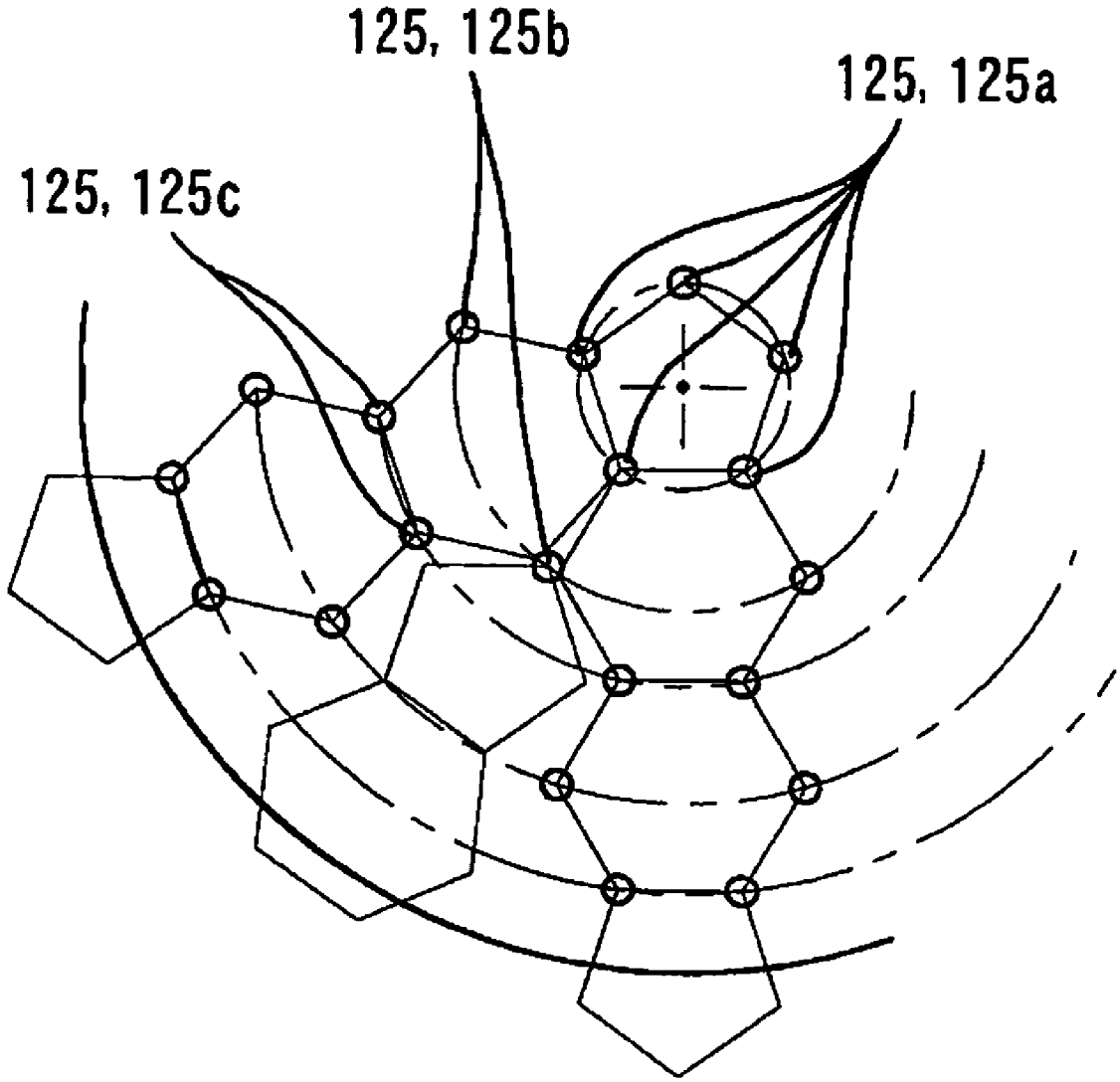
FIG. 4 schematically shows the positional relationship between the communication holes in the partition.

As seen from FIG. 4 which schematically shows the partition 123 as viewed from the side of the second combustion chamber 122, the communication holes 125 are formed in the partition 123 such that each hole 125 is arranged equidistant from three other adjacent communication holes 125. In this case, lines connecting the adjacent communication holes 125 form regular hexagons. In this manner, the numerous communication holes 125 are evenly and systematically arranged on the interface of the partition 123.

Figure 5:
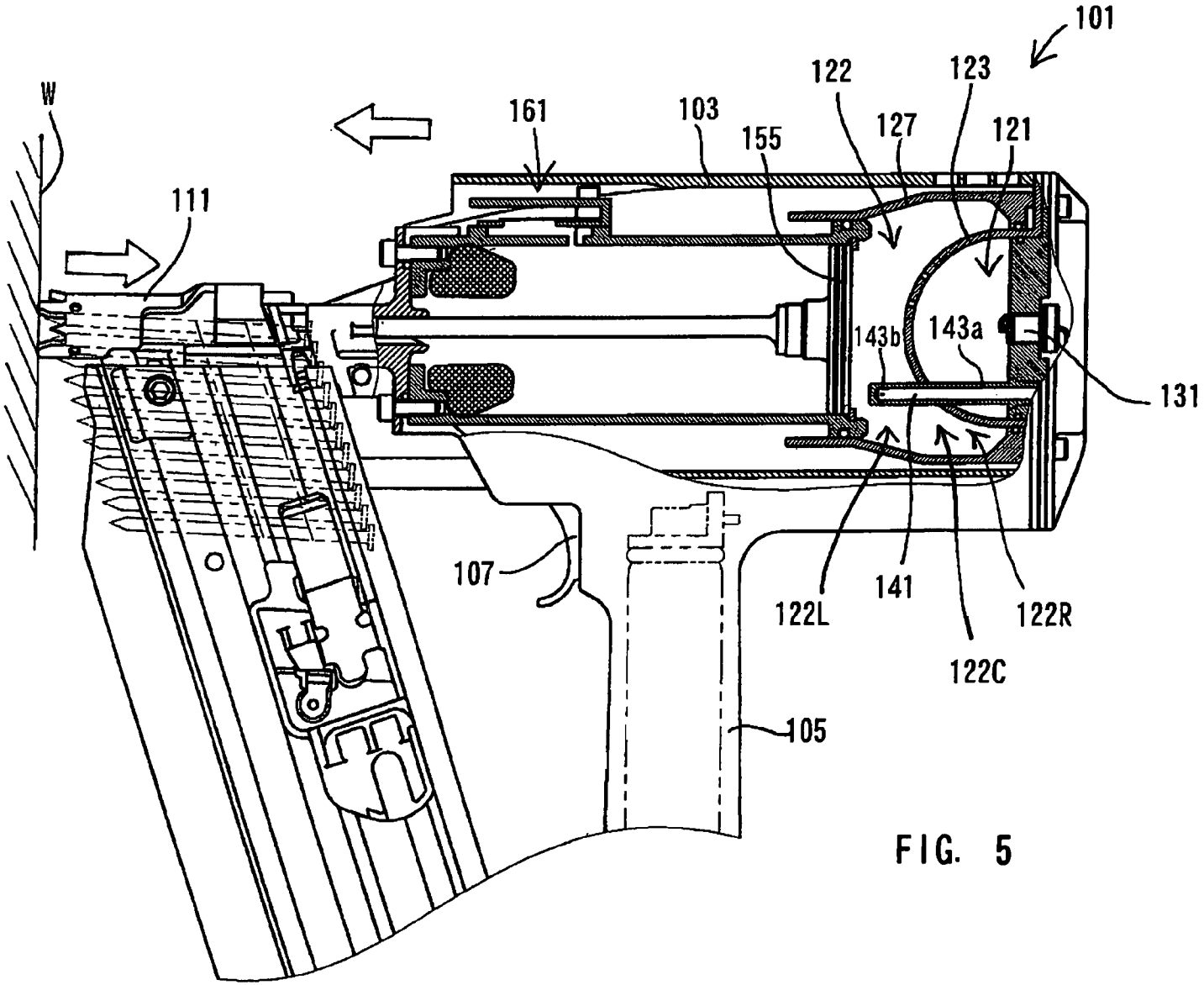
FIG. 5 shows the nailing machine in the state in which user of the machine depresses the trigger while pressing the nailing machine upon the workpiece.

As particularly shown in FIG. 5, the second combustion chamber 122 is defined by a piston 155 that forms the driving mechanism, a slide sleeve 127 and the partition 123. Although it is not particularly shown, the slide sleeve 127 is normally biased toward a contact arm 111. Thus, the slide sleeve 127 normally holds the first and the second combustion chambers 121, 122 in an opened state and allows the combustion chambers 121, 122 to communicate with the outside via the bleed holes 104. When the nailing machine 101 is pressed upon a workpiece W, the contact arm 111 retracts in a direction away from the workpiece W. At the same time, the slide sleeve 127 closes the second combustion chamber 122. Thus, the first combustion chamber 121 is also cut off from communication with the outside. Specifically, the slide sleeve 127 functions as an element that forms a side wall surface of the second combustion chamber 122 and also as a means for controlling the opening and closing of the combustion chambers 121, 122 such that communication of the combustion chambers 121, 122 with the outside is allowed and prevented by the axial sliding movement of the nailing machine 101. The movement of the slide sleeve 127 during a nailing operation will be described below.

The second combustion chamber 122 is shaped like a barrel with respect to its longitudinal direction (the longitudinal direction LA of the first combustion chamber 121 as shown in FIG. 2). Specifically, as shown in FIG. 5, the second combustion chamber 122 includes an end region 122L on the side of the piston 155, a central region 122C, and an end region 122R on the side of the first combustion chamber 121, and the central region 122C is larger in the sectional area than the end regions 122L and 122R.

Further, the effective capacity of the first combustion chamber 121 is about 40% of that of the second combustion chamber 122. As for a power tool in which the first combustion chamber 121 is used as a space for ignition of the mixture and a high energy for driving the power tool is obtained by the burning action in the second combustion chamber 122, the percentage of the capacity of the first combustion chamber 121 to the second combustion chamber 122 may be appropriately selected from design specifications, for example, of about 10 to 40%.

The igniter 131 comprises a spark plug. The ignition part 133 is disposed generally in the center of the end wall surface 129 of the first combustion chamber 121 and substantially flush with the end wall surface 129. The igniter 131 is designed to perform ignition operation about 0.3 second after the fuel injector 141, which will be described below, starts injecting fuel. Further, the igniter 131 is designed to perform electrical discharges several times in one ignition operation.

The fuel injector 141 is a feature that corresponds to the "fuel supplying means" of the present invention. The fuel injector 141 comprises a pipe-shaped member that extends from the first combustion chamber 121 into the second combustion chamber 122 through the partition 123. As shown in FIG. 2, fuel injection holes 143 are formed in the fuel injector 141 at predetermined appropriate points facing the combustion chambers 121, 122. The fuel injector 141 is connected to a fuel tank (not shown), and receives a fuel supply. The amount of fuel that the fuel injector 141 injects into the first and the second combustion chambers 121, 122 is predetermined individually according to the effective capacity of the combustion chambers 121, 122. Specifically, the number and the diameter of a fuel injection hole 143*a* that faces the first combustion chamber 121 and those of a fuel injection hole 143*b* that faces the second combustion chamber 122 are appropriately chosen according to the capacity of the associated combustion chambers 121, 122. Thus, the timing of fuel supply into the combustion chambers 121, 122 can be optimized.

The opening area of each of the fuel injection holes 143 of the fuel injector 141 is smaller than the area of an open circle having a diameter of 1 mm. Further, each of the fuel injection holes 143*a*, 143*b* is formed perpendicularly to the longitudinal axis LA of the first combustion chamber 121 (the longitudinal axes of the second combustion chamber 122 and the nailing machine 101). Alternatively, all or some of the fuel injection holes 143*a* that face the first combustion chamber 121 may be designed such that fuel can be injected toward the igniter 131. Preferably, a central line of the opening of each of the fuel injection holes 143*a* may substantially coincide with or form the angle of 25° or less with a line connecting the fuel injection hole 143*a* and the ignition part 133 of the igniter 131.

As shown in FIG. 1, the driving mechanism 151 mainly includes a cylinder 153 disposed within the main housing 103, the piston 155 that is slidably disposed within the cylinder 153, and the piston rod 157 that is integrally formed with the piston 155. Although it is not particularly shown, the end of the piston rod 157 is connected to a nail ejecting device that is disposed within a nail ejection part 110 and serves to eject nails N forward. A cushion rubber 159 is appropriately disposed in the forward end within the cylinder 153 and serves to absorb and alleviate the impact of the piston 155 which is driven at high speed. A non-return valve 161 is provided on the cylinder 153 and serves to communicate the bore of the cylinder 153 with the outside of the nailing machine 101. The non-return valve 161 is a one-way valve which allows fluid to flow out of the inside of the bore of the cylinder 153, but prevents fluid to flow into the bore of the cylinder 153 from the outside.

Magazine 109 is detachably mounted to the nail ejection part 110 on the forward end of the main housing 103 of the nailing machine 101. The magazine 109 contains numerous nails N connected by a link and places a nail N, into the ejection part 110, to be driven next.

Contact arm 111 is mounted on the front end of the ejection part 110. The contact arm 111 can slide with respect to the ejection part 110 in the longitudinal direction of the ejection part 110 (the longitudinal direction of the nailing machine 101) and is normally biased to the forward end side (leftward as viewed in FIG. 1) by a biasing means which is not shown. As shown in FIG. 5, when the user applies a pressing force toward the workpiece W upon the nailing machine 101 in order to drive the nails N into the workpiece W, the contact arm 111 relatively retracts in the direction away from the workpiece W (toward the main housing 103) against the biasing force of the biasing means. Upon such movement of the contact arm 111, the slide sleeve 127 also retracts and closes the first and the second combustion chambers 121, 122.

Operation of the nailing machine 101 constructed as described above will now be explained. In order to perform a nailing operation by using the nailing machine 101 shown in FIG. 1, the user applies a pressing force toward the workpiece W upon the nailing machine 101 with the contact arm 111 being held in contact with the workpiece W. Then, the contact arm 111 retracts in the direction away from the workpiece W against the biasing force of the biasing means. The retracting movement of the contact arm 111 causes the slide sleeve 127 connected to the contact arm 111 to retract. As a result, the slide sleeve 127 closes the second combustion chamber 122 and cuts off the first and the second combustion chambers 121, 122 from communication with the outside. At this time, the first and the second combustion chambers 121, 122 are fully filled with air which flew in through the bleed holes 104 of the main housing 103 before they were cut off from communication with the outside.

In this state, when the user depresses a trigger 107 on the handgrip 105, fuel is injected into the combustion chambers 121, 122 through the fuel injection holes 143*a*, 143*b* (see FIG. 2) of the fuel injector 141. The amount of fuel supply into the first and the second combustion chambers 121, 122 is determined individually in relation to the capacity of the associated combustion chambers 121, 122. The injected fuel is mixed with the air within the combustion chambers 121, 122. Thus, the first and the second combustion chambers 121, 122 are fully filled with the mixture. The mixture is a feature that corresponds to the "flammable gas" in the present invention. At least one of the fuel injection holes 143 in the first combustion chamber 121 maybe designed such that it extends toward the ignition part 133 or its vicinity. For this purpose, preferably, the central line of the opening of the fuel injection hole 143*a* may form the angle of about 25° or less with respect to the line connecting the fuel injection hole 143*a* and the ignition part 133 of the igniter 131. With this construction, the flammable gas is sufficiently supplied to the vicinity of the ignition part 133. Thus, the combustion characteristic in the first combustion chamber 121 can be further improved.

In this embodiment, the igniter 131 in the first combustion chamber 121 is designed to perform an ignition operation about 0.3 second after the start of fuel injection into the combustion chambers 121, 122. Further, the igniter 131 is designed to perform electrical discharges from the ignition part 133 several times in one ignition operation. Thus, the igniting and burning operations in the first combustion chamber 121 can be smoothly and efficiently performed.

Upon the ignition operation by the igniter 131, the mixture filled in the first combustion chamber 121 is ignited starting from the region in the vicinity of the ignition part 133 and thus starts burning. The burning action of the mixture is explosive, and thus the burning front (flame front) of the mixture reaches the partition 123 in a extremely short time. In this embodiment, as shown in FIG. 2, the communication holes 125 are divided into groups 125*a*, 125*b*, 125*c* . . . , and the communication holes 125 of each group are formed in the partition 123 at a different angle from those of the other groups with respect to the longitudinal axis LA of the first combustion chamber 121. In other words, numerous communication holes 125 are formed in the interface of the partition 123 that separates the first combustion chamber 121 and the second combustion chamber 122, not only in the circumferential direction but in the radial direction of the partition 123. With this construction, the burning front of the mixture which is formed in the first combustion chamber 121 by the igniter 131 extends over the entire interface of the partition 123 and reaches the second combustion chamber 122 through the communication holes 125.

Moreover, in this embodiment, the partition 123 comprises the spherical portion 124 having its center on the ignition part 133. Thus, the burning front of the mixture originating from the ignition part 133 reaches the entire spherical portion 124 substantially at the same time. Therefore, ignition in the second combustion chamber 122 can be started simultaneously over the interface of the partition 123 through the communication holes 125. Thus, the timing of starting combustion in the second combustion chamber 122 can be effectively controlled.

Further, as shown in FIG. 2, the central line CL of any of the communication holes 125 extends toward the ignition part 133. Thus, the resistance that the burning front which has radially diffused from the ignition part 133 in the first combustion chamber 121 receives when it passes through the communication holes 125 can be minimized. In other words, the combustion pressure generated in the first combustion chamber 121 can be transmitted to the second combustion chamber 122 while loss of the combustion pressure is kept to a minimum.

As mentioned above, the burning front formed in the first combustion chamber 121 reaches each of the numerous communication holes 125, which are formed at different angles with respect to the longitudinal axis LA of the first combustion chamber 121, substantially at the same time, while radially diffusing from the ignition part 133. Then, the burning front reaches the second combustion chamber 122, smoothly passing through each of the communication holes 125 of which central line CL extends toward the ignition part 133. At this time, the mixture within the second combustion chamber 122 is simultaneously ignited starting from the entire surface region of the partition 123, and thus combustion of the mixture starts within the second combustion chamber 122. Further, the communication holes 125 are formed in the partition 123 such that each hole 125 is located equidistant from the other three adjacent holes 125 (see FIG. 4). Therefore, the mixture within the second combustion chamber 122 can start burning evenly over the entire surface of the partition 123.

Figure 6:
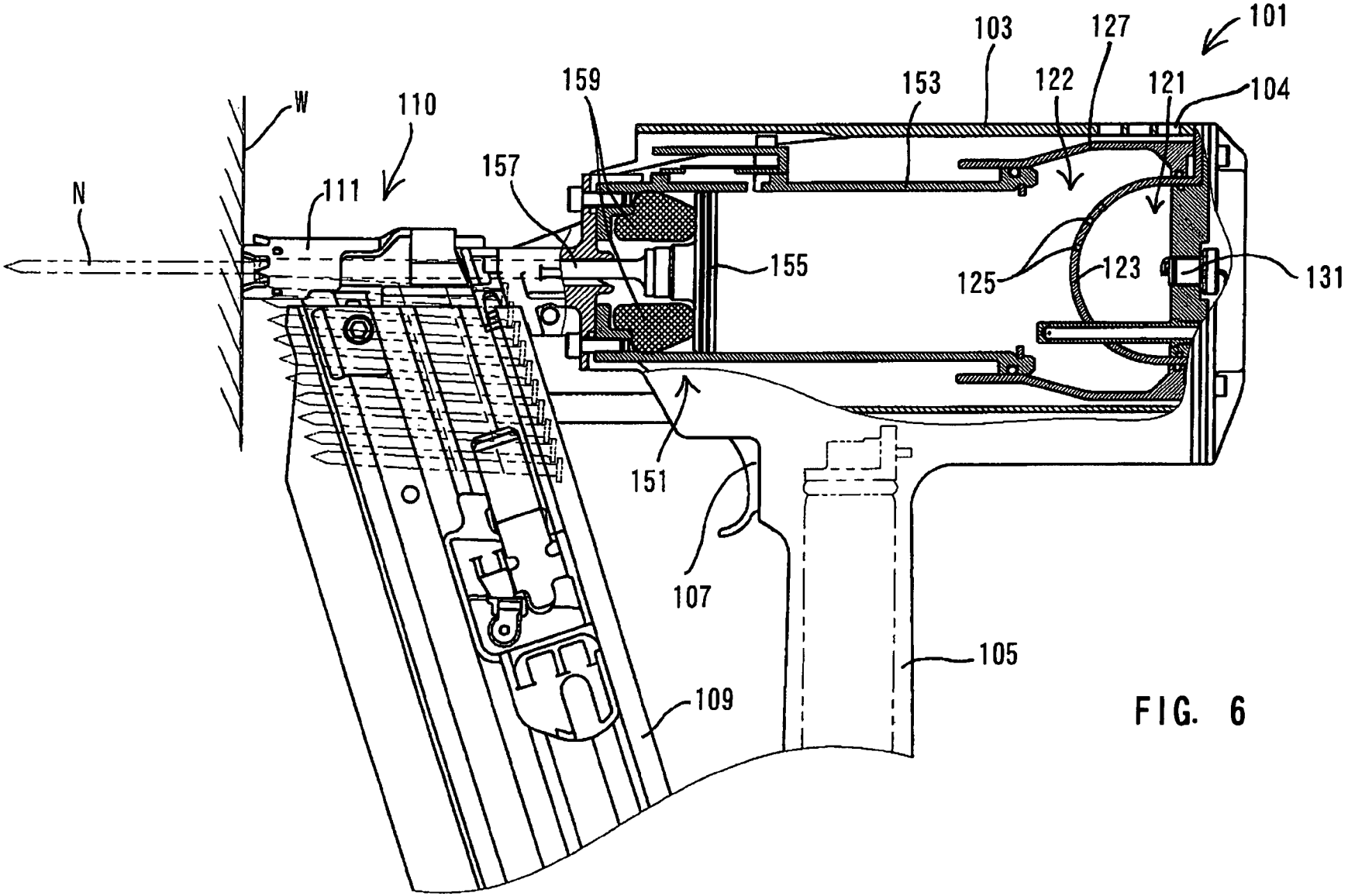
FIG. 6 shows the nailing machine in the state in which the driving mechanism is actuated by means of the burning action in the first and the second combustion chambers and a nail is driven into the workpiece.

The second combustion chamber 122 has a larger capacity than the first combustion chamber 121, and a greater combustion pressure is generated by combustion of the mixture within the second combustion chamber 122. As mentioned above, the second combustion chamber 122 has the end region 122L on the side of the piston 155, the central region 122C, and the end region 122R on the side of the first combustion chamber 121, and the central region 122C is larger in the sectional area than the end regions 122L and 122R with respect to the longitudinal direction of the second combustion chamber 122 (see FIG. 5). Therefore, the burning front of the mixture within the second combustion chamber 122 which was ignited in the vicinity of the partition 123 moves toward the driving mechanism 151 along an arc along the inner wall surface of the second combustion chamber 122 (i.e. the inner wall surface of the retracted slide sleeve 127). Thus, as shown in FIG. 6, the piston 155 slides toward the workpiece W within the cylinder 153 by the action of combustion energy of the mixture within the second combustion chamber 122 and the action of combustion energy of the mixture within the first combustion chamber 121 which is introduced into the second combustion chamber 122 through the communication holes 125.

When the piston 155 slides within the cylinder 153, the space within the cylinder 153 on the side of the piston rod 157 is reduced. However, because air within the reduced space is allowed to escape to the outside via the non-return valve 161 (see FIG. 1), such space reduction does not prevent the sliding movement of the piston 155.

When the piston 155 slides within the cylinder 153, the piston rod 157 moves linearly toward the workpiece W. As a result, as shown in FIG. 6, the nail N placed in the ejection part 10 is ejected at a high speed toward the workpiece W and driven into the workpiece W. At this time, the piston 155 that has moved at high speed toward the workpiece W within the cylinder 153 abuts against the cushion rubber 159. The cushion rubber 159 absorbs and alleviates the kinetic energy of the piston 155, so that the piston 155 stops.

In the stage of completing the operation of driving the nail N, the burned gas within the second combustion chamber 122 which has expanded due to the sliding movement of the cylinder 155 is cooled as a result of its expansion. As a result, the piston 155 automatically starts retracting in the direction away from the workpiece W. Thereafter, when the user stops applying the pressing force on the nailing machine in the direction toward the workpiece W, the contact arm 111 which has retracted relatively toward the main housing 103 moves forward (toward the workpiece W) by the biasing force of the biasing means. Upon such movement of the contact arm 111, the slide sleeve 127 moves forward (toward the cylinder 153). As a result, the first and the second combustion chambers 121, 122 are opened. Thus, the combustion chambers 121, 122 communicate with the outside of the nailing machine 101 via the bleed holes 104 of the main housing 103. Also, the burned gas within the combustion chambers 121, 122 is discharged to the outside via the bleed holes 104. As a result, the nailing machine 101 returns to its initial state shown in FIG. 1.

As shown in FIG. 2, the communication holes 125 are divided into groups 125*a*, 125*b*, 125*c* . . . , and the communication holes 125 of each group are formed in the partition 123 at a different angle from those of the other groups with respect to the longitudinal axis LA of the first combustion chamber 121. Therefore, the burning front of the mixture which is formed in the first combustion chamber 121 by the igniter 131 extends over the entire interface of the partition 123 and reaches the second combustion chamber 122 through the communication holes 125. Further, the partition 123 comprises the spherical portion 124 having its center on the ignition part 133 of the igniter 131. Thus, the burning front of the mixture which is formed in the first combustion chamber 121 reaches each of the communication holes 125 of the partition 123 substantially at the same time, while radially diffusing toward the partition 123. In this embodiment, in cooperation of these features, the flammable gas filled in the second combustion chamber 122 is simultaneously and evenly ignited starting from the entire surface region of the partition 123. Thus, the flammability of the mixture within the second combustion chamber 122 (the main combustion chamber) can be improved, so that the nailing capability of the nailing machine 101 can be enhanced.

SECOND REPRESENTATIVE EMBODIMENT OF THE INVENTION

Figure 7:
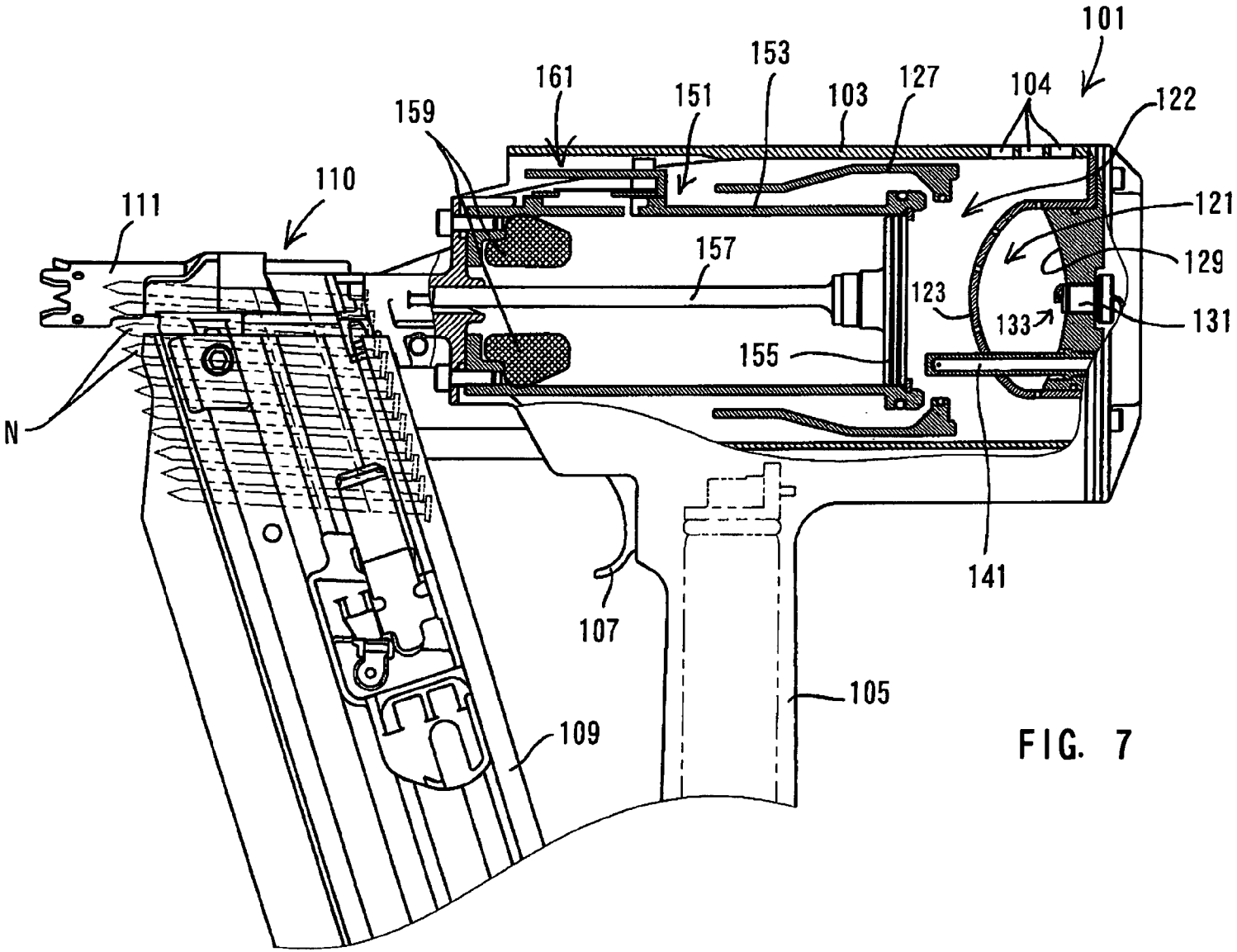
FIG. 7 is a front view, partly in section, showing an entire nailing machine according to the second representative embodiment of the invention.
Figure 8:
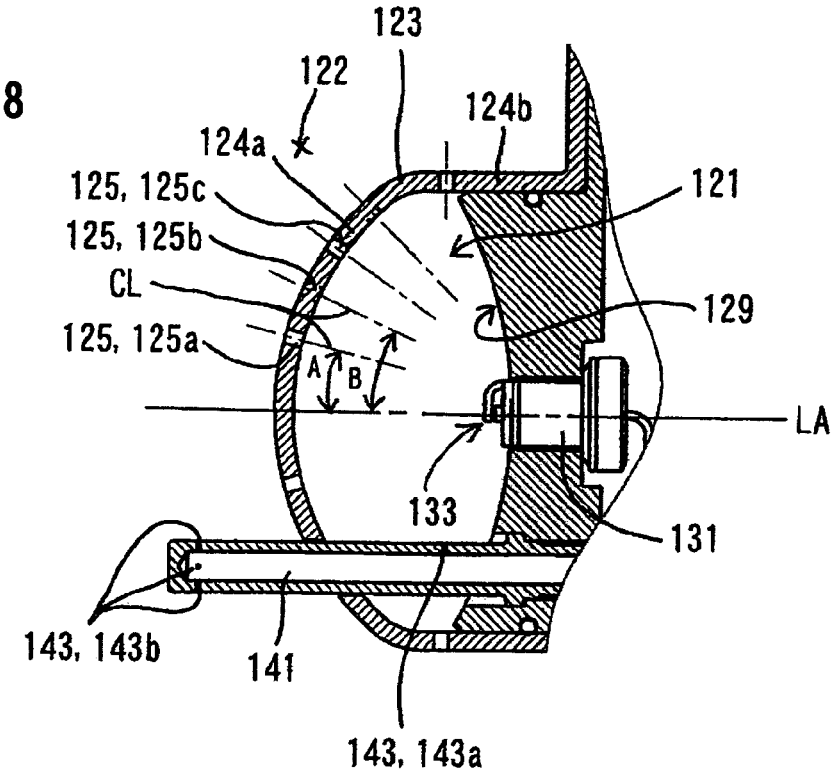
FIG. 8 is a detailed front view of FIG. 7 showing a partition that separates a first combustion chamber from a second combustion chamber according to the second embodiment.

Now, second representative embodiment of the invention is described in detail. As shown in FIGS. 7 and 8, the first combustion chamber 121 is defined by a partition 123 that separates the first combustion chamber 121 from the second combustion chamber 122 and an end wall surface 129 that is located on the side remote from the second combustion chamber 122. An ignition part 133 of an igniter 131 is disposed in the central region of the end wall surface 129. The end wall surface 129 comprises a concave surface that curves radially outward from its central region to its circumferential edge portion in a direction toward the driver 151 (toward the second combustion chamber 122 on the left side as viewed in FIG. 7). In other words, the end wall surface 129 comprises a curved surface that curves rightward as viewed in FIG. 7. The curved surface of the end wall surface 129 is a feature that corresponds to the "concave portion" in the present invention. The concave surface of the end wall surface 129 is formed such that its circumferential edge portion is nearer to the second combustion chamber 122 than its central region in which the ignition part 133 is disposed. Thus, the burning front of the mixture which was ignited within the first combustion chamber 121 by the igniter 131 can smoothly propagate toward the second combustion chamber 122 and the driving mechanism 151 along the concave surface. The end wall surface 129 is an inner wall surface in which the ignition part 133 of the igniter 131 is disposed in its central region and is a feature that corresponds to the "inner wall surface in which the igniter is disposed" according to this invention. In this embodiment, the first combustion chamber 121 is used as an area for igniting a mixture, which will be described below, while the second combustion chamber 122 is used as an area for obtaining high combustion energy required for a nailing operation.

As shown in FIG. 8, the front tip end of the ignition part 133 is provided to be substantially flush with the end wall surface 129 in order to smoothly lead the burning front of the flammable gas toward the partition 123 (piston 155).

Further, as shown in FIG. 8, the partition 123 comprises a spherical portion 124*a* and a cylindrical portion 124*b*. The spherical portion 124*a* is integrally connected to the forward end (left end as viewed in the drawing) of the cylindrical portion 124*b* and has a hemispherical shape with its center on the ignition part 133. The end portion of the cylindrical portion 124*b* which is remote from the spherical portion 124*a* is connected to the end wall surface 129. The axial section of the cylindrical portion 124*b* defines the axial section of the first combustion chamber 121.

Figure 8A:
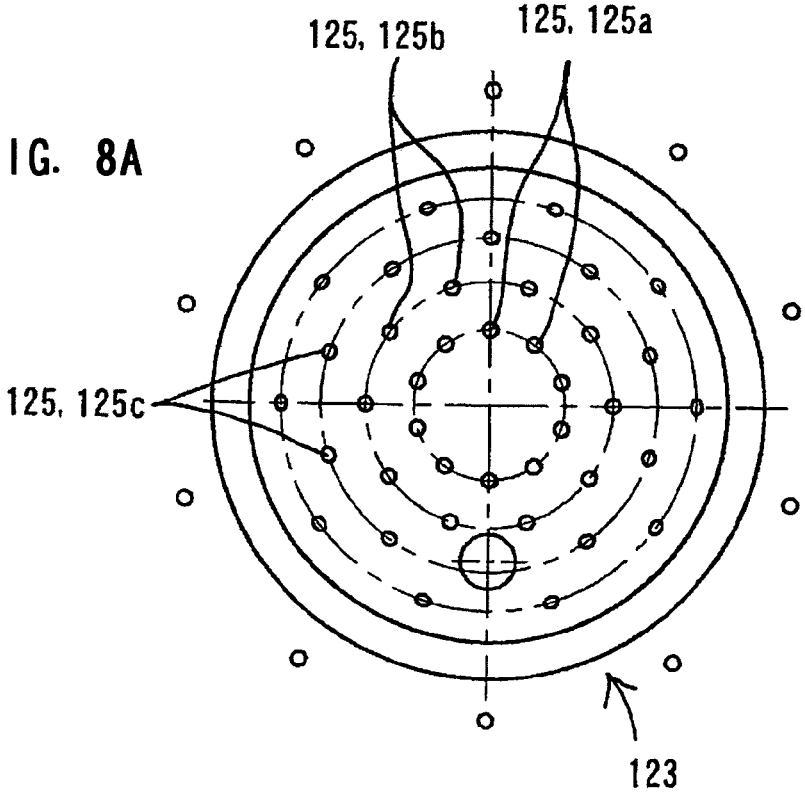
FIG. 8A shows a left side view of FIG. 7 showing a plurality of communication holes formed in the partition.

Numerous communication holes 125 are formed through the spherical portion 124*a* and the cylindrical portion 124*b* of the partition 123. The first combustion chamber 121 communicates with the second combustion chamber 122 via the communication holes 125. As shown in FIG. 8A, which shows the partition 123 as viewed from the side of the second combustion chamber 122, the communication holes 125 formed in the spherical portion 124*a* are divided into a plurality of concentrically arranged groups 125*a*, 125*b*, 125*c* . . . . In order to achieve sufficient combustion even in the circumferential edge region of the first and the second combustion chambers 121, 122, the communication holes 125 of the spherical portion 124*a* which are located nearer to the circumferential edge or the cylindrical portion 124*b* of the partition 123 have a larger opening diameter (area), and the communication holes 125 formed in the cylindrical portion 124*b* have a larger opening diameter than those in the spherical portion 124*a* Further, in this embodiment, in order to improve combustion efficiency, the total opening area of the communication holes 125 per unit volume of the first combustion chamber 121 is within the range of about 2 to 4 $mm^2/cc$.

Further, in this embodiment, as shown in FIG. 8, the communication holes 125 of the first group 125*a* are located at an angle A with respect to a longitudinal axis LA of the first combustion chamber 121. The communication holes 125 of the second group 125*b* are located at an angle B larger than the angle A with respect to the longitudinal axis LA of the first combustion chamber 121. Thus, the angles of the communication holes 125 of the groups 125*a*, 125*b*, 125*c* . . . with respect to the longitudinal axis LA increase in this order. In other words, the communication holes 125 of each group are formed in the partition 123 at a different angle from those of the other groups with respect to the longitudinal axis LA. Thus, in this embodiment, the communication holes 125 are systematically arranged over the partition 123 from its central side to its circumferential edge side. The first and the second combustion chambers 121, 122 communicate with each other via the communication holes 125. In this embodiment, although it is not shown, the longitudinal axis LA of the first combustion chamber 121 coincides with the longitudinal axes of the second combustion chamber 122 and the nailing machine 101.

Further, in this embodiment, a central line CL of each of the communication holes 125 of any group in the spherical portion 124*a* extends toward the ignition part 133 of the igniter 131.

Upon the ignition operation by the igniter 131, the mixture filled in the first combustion chamber 121 is ignited starting from the region in the vicinity of the ignition part 133 and thus starts burning. The burning action of the mixture is explosive, and thus the burning front (flame front) of the mixture reaches the partition 123 in a extremely short time. At this time, as mentioned above, due to the concave configuration of the end wall surface 129 of the first combustion chamber 121, the flammable gas within the first combustion chamber 121 is smoothly led to the partition 123 along the concave end wall surface 129. Thus, the combustion energy generated in the first combustion chamber can be efficiently transferred to the partition 123.

Further, in this embodiment, as shown in FIG. 8, the communication holes 125 of the spherical portion 124*a* of the partition 123 are divided into groups 125*a*, 125*b*, 125*c* . . . , and the communication holes 125 of each group are formed at a different angle from those of the other groups with respect to the longitudinal axis LA of the first combustion chamber 121. In other words, numerous communication holes 125 are formed in the interface of the partition 123 that separates the first combustion chamber 121 and the second combustion chamber 122, not only in the circumferential direction but in the radial direction of the partition 123. Further, the cylindrical portion 124*b* of the partition 123 also has communication holes 125. Thus, the burning front of the mixture which is formed in the first combustion chamber 121 by the igniter 131 extends over the entire interface of the partition 123 and reaches the second combustion chamber 122 through the communication holes 125 of the spherical portion 124*a* and the cylindrical portion 124*b*.

Moreover, in this embodiment, the spherical portion 124 of the partition 123 has a spherical shape with its center on the ignition part 133. Thus, the burning front of the mixture originating from the ignition part 133 reaches the entire spherical portion 124*a* substantially at the same time. Therefore, ignition in the second combustion chamber 122 can be started simultaneously over the spherical portion 124*a* of the partition 123 through the communication holes 125. Thus, the timing of starting combustion in the second combustion chamber 122 can be effectively controlled.

Further, as shown in FIG. 8, the central line CL of any of the communication holes 125 of the spherical portion 124*a* of the partition 123 extends toward the ignition part 133. Thus, the resistance that the burning front which has radially diffused from the ignition part 133 in the first combustion chamber 121 receives when it passes through the communication holes 125 of the spherical portion 124*a* can be minimized. In other words, the combustion pressure generated in the first combustion chamber 121 can be transmitted to the second combustion chamber 122 while loss of the combustion pressure in the spherical portion 124*a* is kept to a minimum.

As mentioned above, the burning front formed in the first combustion chamber 121 radially diffuses from the ignition part 133 while being efficiently guided along the concave end wall surface 129. Then the burning front reaches the second combustion chamber 122 through the communication holes 125 of the spherical portion 124*a* and the cylindrical portion 124*b* of the partition 123. The burning front reaches each of the numerous communication holes 125 of the spherical portion 124*a*, which are formed at different angles with respect to the longitudinal axis LA of the first combustion chamber 121, substantially at the same time. Then, the burning front reaches the second combustion chamber 122, smoothly passing through each of the communication holes 125 of which central line CL extends toward the ignition part 133. At this time, the mixture within the second combustion chamber 122 is evenly ignited starting from the entire surface region of the partition 123, and thus combustion of the mixture starts within the second combustion chamber 122.

MODIFICATION OF THE SECOND REPRESENTATIVE EMBODIMENT

Figure 9:
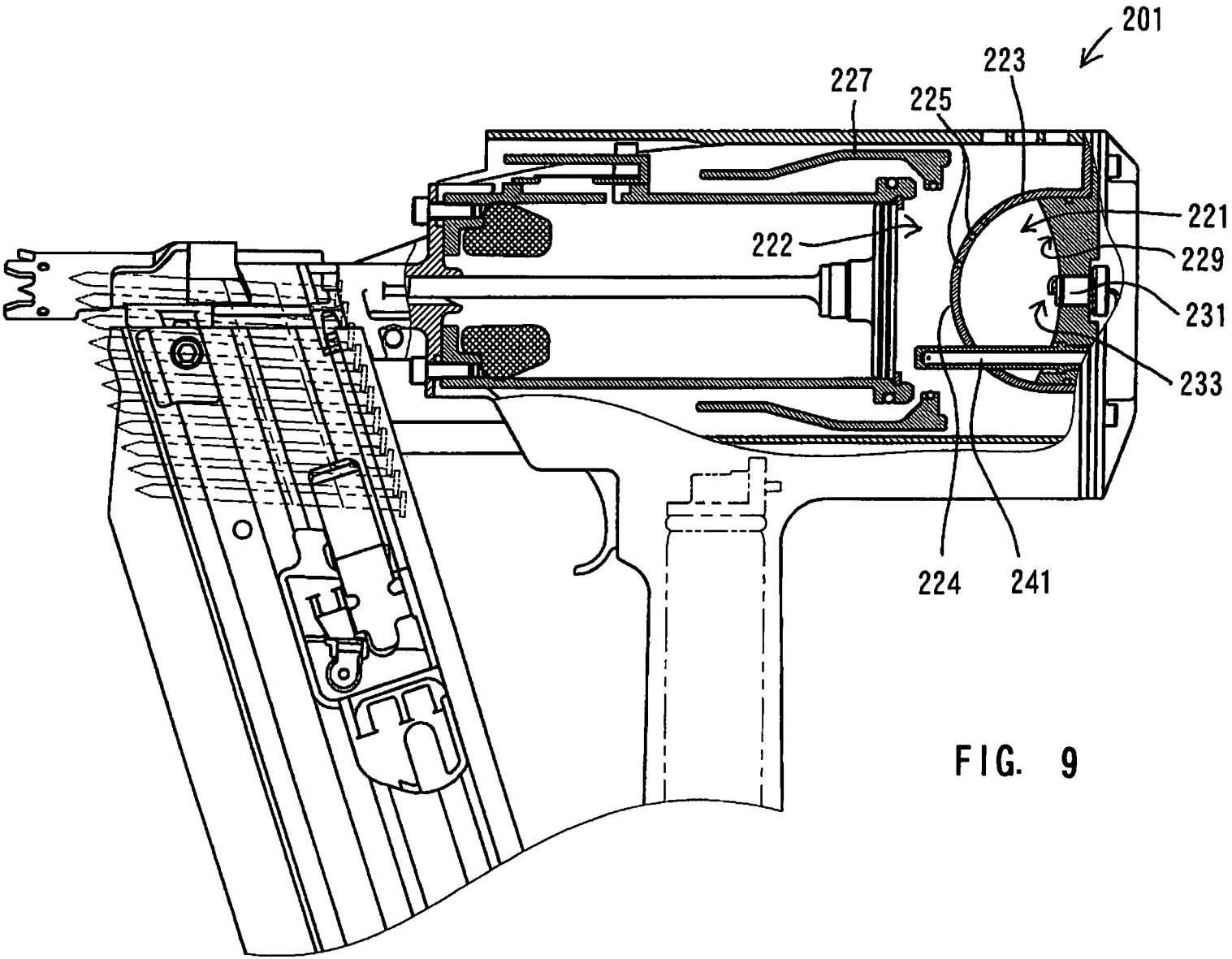
FIG. 9 shows a modification of the second representative embodiment.

FIG. 9 shows a modification made to the above-mentioned second representative embodiment relating to the configuration of the partition 123. Therefore, components and elements having the same effect as in the above embodiment will not be described below in detail. A nailing machine 201 according to this modification includes a first combustion chamber 221 having a concave end wall surface 229, a second combustion chamber 222 that is defined when a slide sleeve 227 retracts, and a partition 223 that separates the first combustion chamber 221 from the second combustion chamber 222. The partition 223 has a hemispherical shape having its center on an ignition part 233 of an igniter 231. Numerous communication holes 225 are formed in the spherical portion of the partition 223.

With this construction, the burning front of the mixture which is formed in the first combustion chamber 221 reaches each of the communication holes 225 of the partition 223 substantially at the same time, while radially diffusing toward the partition 223. Thus, the flammable gas filled in the second combustion chamber 222 is simultaneously and evenly ignited starting from the entire surface region of the partition 223. Thus, the flammability of the mixture within the second combustion chamber 222 (the main combustion chamber) can be improved, so that the nailing capability of the nailing machine 201 can be enhanced.

In the above embodiment, the partition 123 has the spherical portion 124*a*, and in the above-mentioned modification, the partition 223 as itself is hemispherical. However, they may not be spherical but may be appropriately changed into a conical shape.

THIRD REPRESENTATIVE EMBODIMENT OF THE INVENTION

Now, third representative embodiment of the invention is described in detail in reference to FIGS. 10 to 14. In the third embodiment, as shown in FIGS., the partition 123 is fixedly connected to the end portion of the slide sleeve 127 on the side of the first combustion chamber 121 by screws 128. The partition 123 can move together with the slide sleeve 127 in the longitudinal direction of the nailing machine 101.

Figure 10:
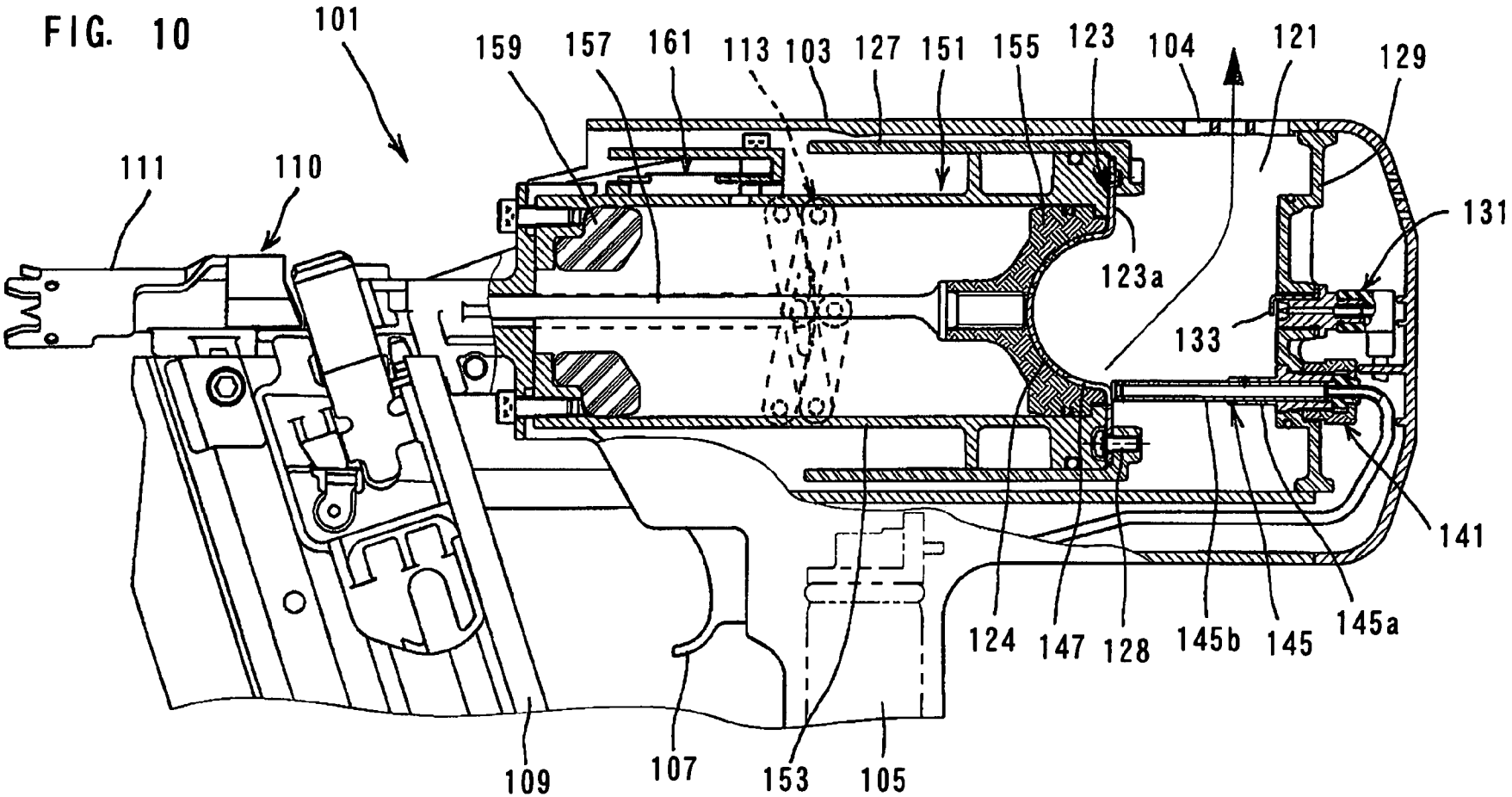
FIG. 10 is a front view, partly in section, showing an entire nailing machine in the initial state according to the third representative embodiment of the invention.

The second combustion chamber 122 is defined by the piston 155 that forms the driving mechanism, the slide sleeve 127 and the partition 123 that faces the piston 155. The top surface (the surface facing the partition 123) of the piston 155 comprises a spherical recess 155*a* that is complementary to the spherical portion 124 of the partition 123. The slide sleeve 127 is connected to a contact arm 111 via a pantograph link mechanism 113 which is shown by broken lines in the drawings. Although it is not particularly shown, the contact arm 111 is normally biased to the forward end side (leftward as viewed in FIGS. 10 to 12) by a biasing means such as a spring. Thus, the slide sleeve 127 moves to the forward end side together with the partition 123 and normally holds the first combustion chamber 121 in an opened state, thereby allowing the combustion chamber 121 to communicate with the outside via the bleed holes 104. At this time, generally the entire surface of the partition 123 is in surface contact with the end surface of the cylinder 153 and the top surface of the piston 155. Thus, the capacity of the second combustion chamber 122 is reduced to zero or nearly to zero. This state defines an initial state of the nailing machine 101 as shown in FIG. 10.

Figure 11:
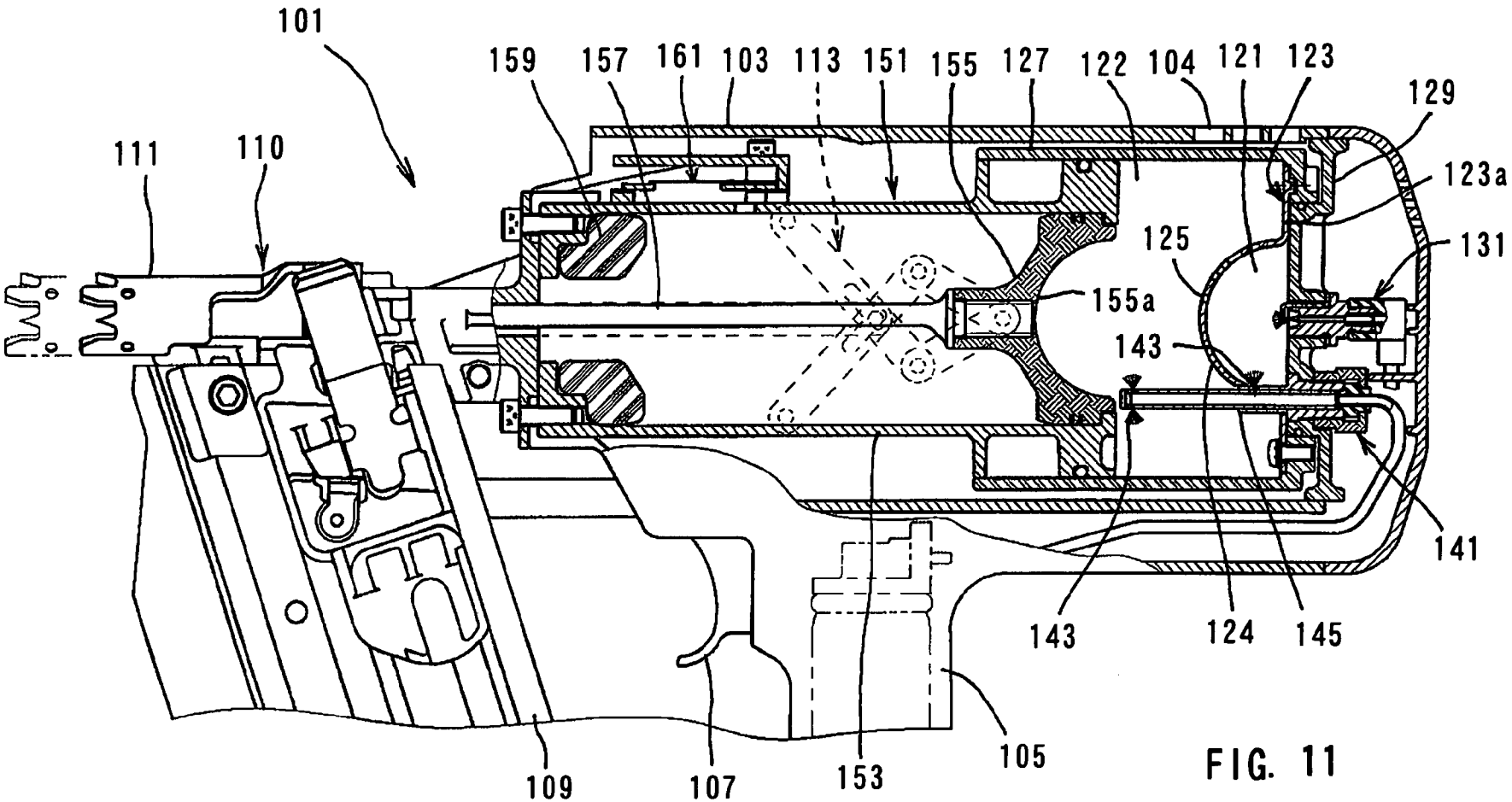
FIG. 11 is a front view of FIG. 10, partly in section, showing the entire nailing machine at the time of ignition.
Figure 12:
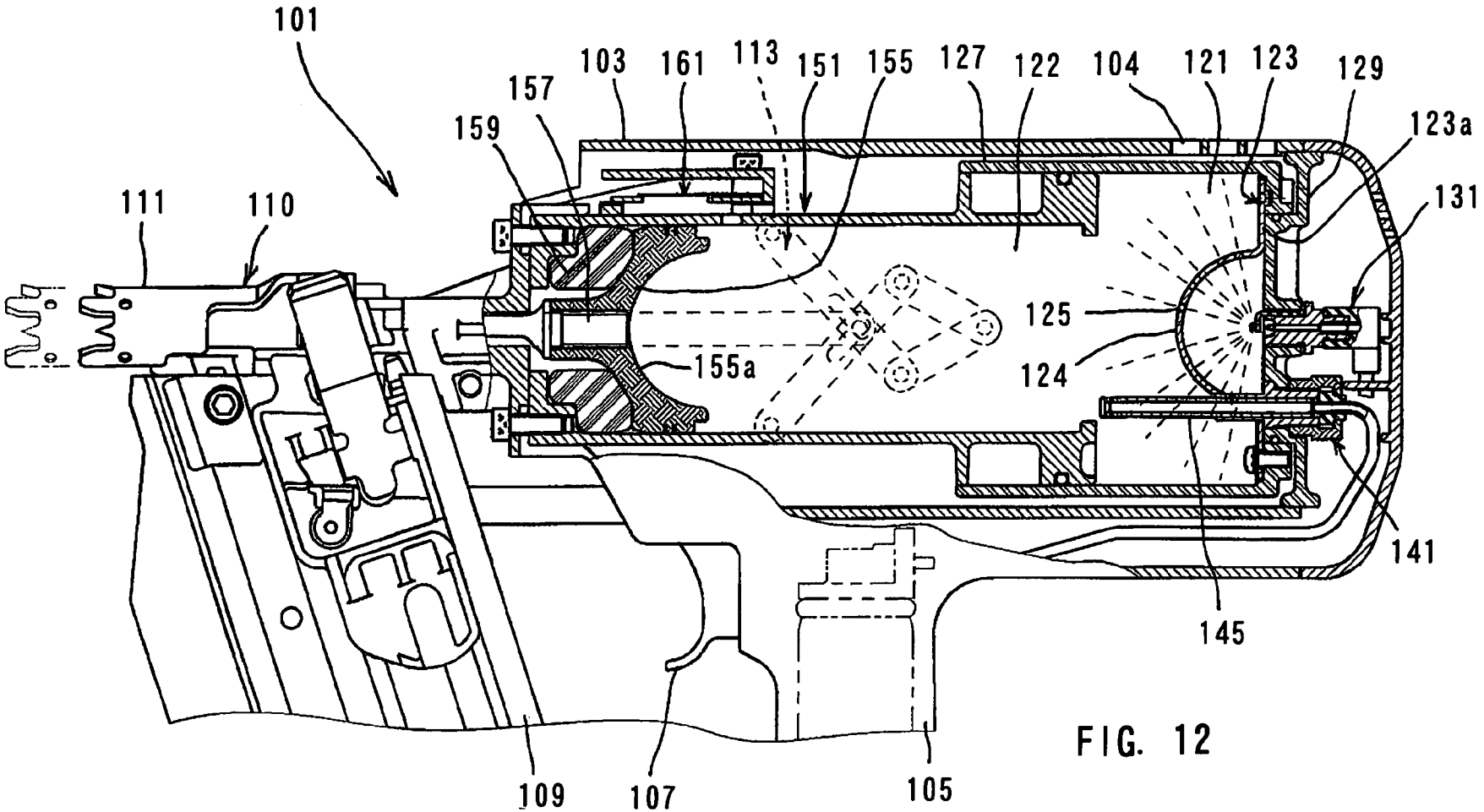
FIG. 12 is a front view of FIG. 10, partly in section, showing the entire nailing machine at the time of explosion.

When the nailing machine 101 is moved toward the workpiece (not shown) and the contact arm 111 is pressed upon the workpiece, the contact arm 111 is pushed back by the workpiece and moves against the biasing force of the biasing means in the opposite direction. The retracting movement of the contact arm 111 is transmitted to the slide sleeve 127 via the pantograph link mechanism 113. The pantograph link mechanism 113 has such a link ratio that it can transmit the travel of the contact arm 111 as increased by several times, to the slide sleeve 127. Thus, the slide sleeve 127 and the partition 123 move toward the end wall surface 129 and the circumferential edge portion of the partition 123 contacts the end wall surface 129 as shown in FIG. 11. At this time, the second combustion chamber 122 is closed and prevented from communicating with the outside through the bleed holes 104. Specifically, the slide sleeve 127 serves as an element that forms a side wall surface of the second combustion chamber 122 and also as a means for controlling the opening and closing of the combustion chamber such that communication of the first combustion chamber 121 with the outside is allowed and prevented by the axial sliding movement of the nailing machine 101. The movement of the slide sleeve 127 during a nailing operation will be described below.

The fuel injector 141 comprises a pipe-shaped member 145. The pipe-shaped member 145 is fixedly connected to the end wall surface 129 at its end and extends to the side of the first and second combustion chambers 121, 122. A through hole 147 is formed in the lower edge portion of the spherical portion 124 of the partition 123, and the pipe-like member 145 is allowed to extend into the second combustion chamber 122 through the through hole 147. The through hole 147 comprises an exhaust hole through which combustion gas is led from the first combustion chamber 121 into the second combustion chamber 122.

The pipe-shaped member 145 is defined by a stepped pipe having a large-diameter portion 145*a* on its proximal side (fixed end side) and a small-diameter portion 145*b* on the distal end side. When the flat surface 123*a* of the partition 123 contacts the end wall surface 129, the large-diameter portion 145*a* is located (fitted) within the through hole 147 and closes the through hole 147. When the partition 123 moves toward the piston 155, the small-diameterportion 145*b* is located within the through hole 147 or slipped out of the through hole 147, so that the through hole 147 is opened. Thus, the pipe-like member 145 forms not only a fuel supplying means but an opening-and-closing valve for opening and closing the through hole 147. The through hole 147 is a feature that corresponds to the "exhaust hole" in the present invention. Further, the position in which the partition 123 contacts the end wall surface 129 and defines the first combustion chamber 121 having a predetermined capacity is a feature that corresponds to the "initial position of the partition" in the present invention.

The through hole 147 has an opening area much larger than the communication holes 125. In this embodiment, the opening area of the through hole 147 is about 20 times of that of one communication hole 125 in the completely opened state in which the small-diameter portion 145*b* is slipped out of the through hole 147.

Operation of the nailing machine 101 according to this embodiment will now be explained. The initial state of the nailing machine 101 is shown in FIG. 10. In this initial state, the slide sleeve 127 is moved to the forward end side by the biasing force of the biasing means, so that the first combustion chamber 121 is in communication with the outside. Further, the partition 123 is in contact with the cylinder 153 and the piston 155, so that the capacity of the second combustion chamber 122 is reduced to zero or nearly to zero. In this state, the pipe-like member 145 is located outside the through hole 147 and the through hole 147 is opened.

In this state, in order to perform a nailing operation by using the nailing machine 101, the user applies a pressing force toward the workpiece upon the nailing machine 101 with the contact arm 111 being held in contact with the workpiece. Then, the contact arm 111 retracts in the direction away from the workpiece against the biasing force of the biasing means. The retracting movement of the contact arm 111 causes the slide sleeve 127, which is connected to the contact arm 111 via the pantograph link mechanism 113, to retract by the stroke several times longer than that of the contact arm 111. By this retracting movement, the partition 123 moves toward the end wall surface 129 and the flat surface 123*a* contacts the end wall surface 129, so that the first combustion chamber 121 is cut off from communication with the outside. As a result, as shown in) FIG. 11, the ratio of the capacity of the first combustion chamber 121 to that of the second combustion chamber 122 stands at a predetermined ratio. At this time, the large-diameter portion 145*a* of the pipe-like member 145 is fitted into the through hole 147 and closes the through hole 147.

In this state, when the user depresses a trigger 107 on the handgrip 105, fuel is injected into the combustion chambers 121, 122 through the fuel injection holes 143*a*, 143*b* (see FIG. 11) of the fuel injector 141. The amount of fuel supply into the first and the second combustion chambers 121, 122 is set individually according to the capacity of the associated combustion chambers 121, 122. The injected fuel is mixed with the air within the combustion chambers 121, 122. Thus, the first and the second combustion chambers 121, 122 are fully filled with the mixture. The way of burning the mixture within the first and the second combustion chambers 121, 122 is the same as in the first embodiment.

Figure 13:
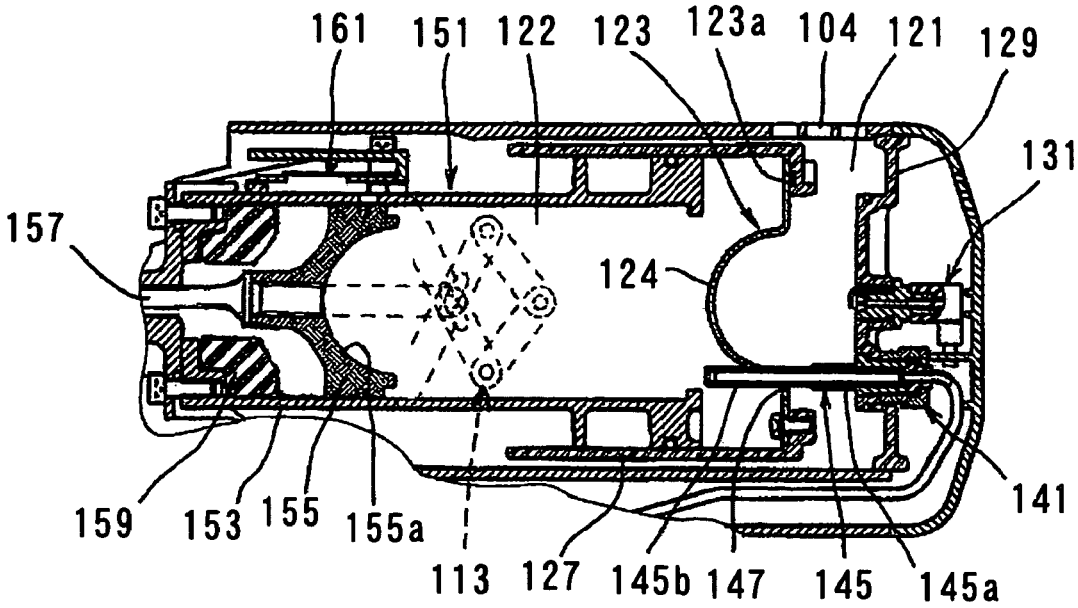
FIG. 13 is a sectional partial view of the nailing machine on its way back to its initial position after explosion.

In the stage of completing the nailing operation, the burned gas within the first and the second combustion chambers 121, 122 which have expanded due to the sliding movement of the cylinder 155 is cooled. As a result, the piston 155 automatically starts retracting in the direction away from the workpiece. Thereafter, when the user stops applying the pressing force on the nailing machine in the direction toward the workpiece, the contact arm 111 which has retracted relatively toward the main housing 103 moves forward (toward the workpiece W) by the biasing force of the biasing means. Upon such movement of the contact arm 111, the slide sleeve 127 and the partition 123 move forward (toward the piston 155). As a result, as shown in FIG. 13, the first combustion chamber 121 is opened and communicates with the outside of the nailing machine 101 via the bleed holes 104 of the main housing 103.

The forward movement of the partition 123 is governed by the time when the user stops applying the pressing force on the nailing machine in the direction toward the workpiece. This movement of the partition 123 is performed after the piston 155 has completed its retracting movement. Specifically, the retracting movement of the piston 155 is instantaneously achieved by the suction force which is caused by the cooling action within the first and the second combustion chambers 121, 122. Therefore, as long as the user stops applying the pressing force on the nailing machine in the direction toward the workpiece in a normal manner, the piston 155 completes its retracting movement and is returned to its initial position from which it starts moving forward.

Figure 14:
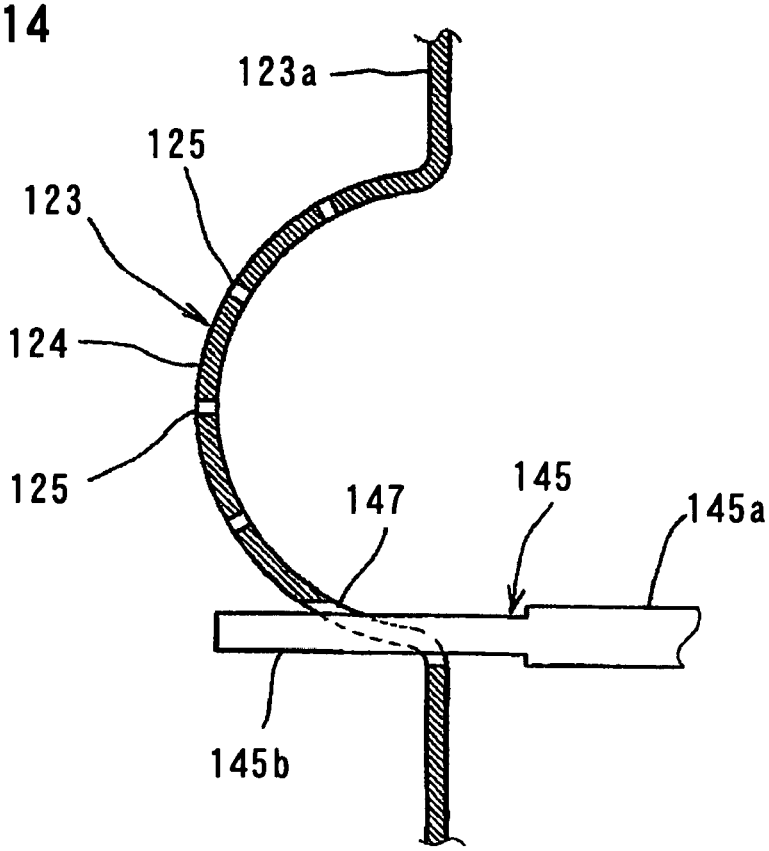
FIG. 14 is an enlarged view showing how the through hole of the partition is opened by the pipe-shaped member.

With such retracting movement of the piston 155 and the forward movement of the partition 123 (toward the piston 155), the capacity of the second combustion chamber 122 starts decreasing. By the forward movement of the partition 123, as shown in FIG. 13, the bleed holes 104 are opened and the first combustion chamber 121 communicates with the outside. As shown in FIG. 14, the through hole 147 slips away from the large-diameter portion 145*a* and receives the small-diameter portion 145*b*, so that the through hole 147 is opened. As a result, a gas flow from the through hole 147 to the bleed holes 104 is formed within the first combustion chamber 121. Thus, the combustion gas within the second combustion chamber 122 is introduced into the first combustion chamber 121 through the through hole 147 and then discharged to the outside through the bleed holes 104 together with the combustion gas within the first combustion chamber 121.

Numerous communication holes 125 are formed in the partition 123. Therefore, the combustion gas within the second combustion chamber 122 flows into the first combustion chamber 121 through the communication holes 125. This gas flow is directed toward the center of the combustion chamber (because the communication holes 125 extends through the partition 123 toward the ignition part 133). Further, the opening area of each of the communication holes 125 is much smaller than that of the through hole 147, and the flow rate through the communication hole 125 is lower than the flow rate through the through hole 147. Therefore, the gas flow toward the bleed holes 104 via the through hole 147 provides a main flow in the first combustion chamber 121.

The partition 123 moves into contact with the piston 155. As a result, the capacity of the second combustion chamber 122 is reduced to zero or nearly to zero. At this time, the small-diameter portion 145*b* of the pipe-shaped member 145 completely slips out of the through hole 147 and the through hole 147 is fully opened. Thus, the nailing machine 101 is returned to its initial position shown in FIG. 10.

In the nailing machine 101 having the first and the second combustion chambers 121, 122, combustion gas is discharged when the piston 155 and the partition 123 are moved such that the capacity of the second combustion chamber 122 is reduced. Therefore, upon movement of the piston 155 and the partition 123, the combustion gas is pushed with a great force out of the second combustion chamber 122 into the first combustion chamber 121 through the through hole 147. As a result, the flow of the combustion gas into the first combustion chamber 121 gains greater momentum.

In the first combustion chamber 121, a gas flow from the through hole 147 to the bleed holes 104 is formed. Specifically, a gas flow from the second combustion chamber 122 into the first combustion chamber 121 is formed, and by this gas flow, the combustion gas in the second combustion chamber 122 is discharged to the outside together with the combustion gas in the first combustion chamber 121. The through hole 147 is formed in the lower edge portion of the spherical portion 124 of the partition 123 and is located on the side opposite to the bleed holes 104 with respect to the axial line of the first combustion chamber 121. Therefore, within the first combustion chamber 121, as show by arrow in FIG. 10, the combustion gas that has been led into the first combustion chamber 121 through the through hole 147 flows toward the bleed holes 104 across the central region of the first combustion chamber 121. Specifically, a gas flow is formed running diagonally from one corner to the other of the first combustion chamber 121. By this gas flow, the combustion gas that has been led from the second combustion chamber 122 into the first combustion chamber 121 and the combustion gas within the first combustion chamber 121 are smoothly discharged to the outside through the bleed holes 104.

According to this embodiment, with a simple construction in which one of the combustion chambers is reduced in capacity, combustion gas can be efficiently discharged. Further, the pipe-shaped member 145 functions not only inherently as an fuel injector 141 but as an opening-and-closing valve for opening and closing the through hole 147 for gas exhaust. Therefore, the number of component parts can be reduced and thus the construction can be simplified.

In this embodiment, the partition 123 is integrally connected to the slide sleeve 127 and moves together with the slide sleeve 127. Further, the surfaces of the partition 123 and the piston 155 that face each other are complementary in shape, so that the capacity of the second combustion chamber 122 is reduced to zero or nearly to zero when the first combustion chamber 121 is opened. After combustion of the flammable gas, by the movement of the slide sleeve 127 and the partition 123, combustion gas within the second combustion chamber 122 is discharged to the atmosphere through the through hole 147 of the partition 123. With such construction, combustion gas can be efficiently discharged by using a smaller number of movable elements.

The construction of this embodiment may be modified such that an element other than the pipe-shaped member 145 is used to open and close the through hole 147. In this case, in order to close the through hole 147, the element may be inserted into the through hole 147 or it may be brought into surface contact with the partition 123.

Further, the construction may be modified such that the bleed holes 104 are formed in the end wall surface 129 and closed by the flat surface 123*a* of the partition 123.

Further, a movable gas guide plate may be provided within the first combustion chamber 121. When the partition 123 moves in a direction of reducing the capacity of the second combustion chamber 122, the gas guide plate may be tilted so as to guide the combustion gas that has been led into the first combustion chamber 121, to the bleed holes 104. Further, it may be constructed such that the partition 123 and the piston 155 move simultaneously.

DESCRIPTION OF NUMERALS

101 nailing machine
103 main housing
104 bleed hole
105 handgrip
107 trigger
109 magazine
111 contact arm
121 first combustion chamber
122 second combustion chamber
123 partition
124 spherical portion
125 communication hole

127 slide sleeve
129 end wall surface
131 igniter
133 ignition part
141 fuel injector
143 fuel injection hole
151 driving mechanism
153 cylinder
155 piston
157 piston rod
159 cushion rubber
161 non-return valve

We claim:

1. A combustion power tool, comprising:

a first combustion chamber and a second combustion chamber into which flammable gas is charged, an igniter disposed in the first combustion chamber, a dome shaped partition that separates the first combustion chamber from the second combustion chamber, communication holes formed in the dome shaped partition at different angles with respect to the longitudinal direction of the first combustion chamber, wherein the communication holes communicating the first combustion chamber with the second combustion chamber, and a driving mechanism that performs a predetermined processing work by utilizing a combustion pressure, the combustion pressure being generated when flammable gas in the first combustion chamber is burned by the igniter and when the burning front of the flammable gas in the first combustion chamber propagates to the second combustion chamber via the communication holes of the dome shaped partition and burns flammable gas in the second combustion chamber, wherein when the flammable gas in the first combustion chamber is burned, the burning front in the first combustion chamber reaches each of the communication holes substantially at the same time.

2. The combustion power tool as defined in claim 1, wherein the dome shaped partition includes a spherical portion centered on the igniter and the communication holes are formed in the spherical portion, and wherein when the flammable gas in the first combustion chamber is burned, the burning front in the first combustion chamber reaches each of the communication holes substantially at the same time.

3. The combustion power tool as defined in claim 1, wherein each of the communication holes is formed in the dome shaped partition in such a manner that a central line of the communication hole extends toward the igniter.

4. The combustion power tool as defined in claim 1, wherein each of the communication holes is arranged substantially equidistant from at least three other adjacent communication holes in the partition.

5. The combustion power tool as defined in claim 1, wherein the second combustion chamber has both end regions and a central region and wherein the central region is larger in the sectional area than the end regions with respect to the longitudinal direction of the second combustion chamber.

6. The combustion power tool as defined in claim 5, wherein the dome shaped partition has a spherical portion in which the igniter is disposed and the spherical portion has generally the same sectional area as at least one of the end regions of the second combustion chamber.

7. The combustion power tool as defined in claim 1, wherein the capacity of the first combustion chamber is about 10 to 40% of the capacity of the second combustion chamber.

8. The combustion power tool as defined in claim 1, wherein the igniter is disposed substantially in a center of a portion of an inner wall surface of the first combustion chamber which faces the dome shaped partition.

9. The combustion power tool as defined in claim 1, wherein the communication holes which are located nearer to the circumferential edge of the dome shaped partition have a larger opening diameter.

10. The combustion power tool as defined in claim 1, wherein the total opening area of the communication holes per unit volume of the first combustion chamber is about 2 to 4 $mm^2/cc$.

11. The combustion power tool as defined in claim 1 further comprising fuel supplier disposed in the first combustion chamber and the second combustion chamber, wherein the amount of fuel supply by the fuel supplier is set individually according to the capacity of the associated combustion chambers.

12. The combustion power tool as defined in claim 1 further comprising fuel supplier disposed in the first combustion chamber and the second combustion chamber, said fuel supplier having a plurality of fuel injection openings, wherein each fuel injection opening of the fuel supplier has a diameter smaller than 1 mm.

13. The combustion power tool as defined in claim 1 further comprising fuel supplier disposed in the first combustion chamber and the second combustion chamber, said fuel supplier having a plurality of fuel injection openings, wherein each fuel injection opening of the fuel supplier is formed perpendicularly to the longitudinal axis of the first and the second combustion chambers.

14. The combustion power tool as defined in claim 1 further comprising fuel supplier disposed in the first combustion chamber and the second combustion chamber, said fuel supplier having a plurality of fuel injection openings, wherein at least one of the fuel injection openings in the first combustion chamber is close to the igniter or a proximity of the igniter.

15. The combustion power tool as defined in claim 1, wherein the igniter performs an ignition operation about 0.3 second after the fuel is supplied.

16. The combustion power tool as defined in claim 1, wherein the igniter performs electrical discharges several times in one ignition operation.

17. The combustion power tool as defined in claim 1 further having an inner wall surface of the first combustion chamber in which the igniter is disposed, wherein the inner wall is opposed to the driving mechanism and the inner wall has a concave portion that curves radially outward from the concave portion's central region to the concave portion's circumferential edge portion in a direction toward the driving mechanism.

18. The combustion power tool as defined in claim 1, wherein the dome shaped partition is provided to move toward the second combustion chamber and wherein the combustion gas burned in the second combustion chamber is introduced into the first combustion chamber when the dome shaped partition is moved to the second combustion chamber so that the capacity of the second combustion chamber is reduced, and the combustion gas within the second combustion chamber is discharged to the outside together with combustion gas burned within the first combustion chamber.

19. A combustion power tool, comprising:

a first combustion chamber and a second combustion chamber into which flammable gas is charged, an igniter disposed in the first combustion chamber, a dome shaped partition that separates the first combustion chamber from the second combustion chamber, wherein the dome shaped partition is provided to move toward the second combustion chamber, communication holes that are formed in the dome shaped partition and serve to communicate the first combustion chamber with the second combustion chamber, and a driving mechanism that is actuated to perform a predetermined processing work by utilizing a combustion pressure, the combustion pressure being generated when flammable gas in the first combustion chamber is burned by the igniter and when the burning front of the flammable gas in the first combustion chamber propagates to the second combustion chamber via the communication holes of the dome shaped partition and burns flammable gas in the second combustion chamber, wherein combustion gas burned in the second combustion chamber is introduced into the first combustion chamber when the dome shaped partition is moved to the second combustion chamber so that the capacity of the second combustion chamber is reduced, and combustion gas burned within the second combustion chamber is discharged to the outside together with combustion gas burned within the first combustion chamber.

20. The combustion power tool as defined in claim 19 further comprising a piston that faces the dome shaped partition across the second combustion chamber, wherein the capacity of the second combustion chamber is reduced when the dome shaped partition and the piston move in a direction toward each other.

21. The combustion power tool as defined in claim 19 further comprising an exhaust hole that is formed in the dome shaped partition, wherein the combustion gas within the second combustion chamber is led into the first combustion chamber through the exhaust hole, the exhaust hole being opened when the dome shaped partition moves in a direction of reducing the capacity of the second combustion chamber and closed when the dome shaped partition returns to its initial position.

22. The combustion power tool as defined in claim 21, wherein the exhaust hole is located such that the combustion gas led into the first combustion chamber flows diagonally from one corner to the other in the first combustion chamber.

23. The combustion power tool as defined in claim 21 further comprising a pipe-shaped member to supply flammable gas, the member including a large-diameter portion, wherein the exhaust hole of the dome shaped partition is closed by the large-diameter portion of the member when the large-diameter portion is inserted through the exhaust hole and wherein, the exhaust hole is opened when the exhaust hole is moved away from the large-diameter portion in relation to the movement of the dome shaped partition in a direction of reducing the capacity of the second combustion chamber.

24. The combustion power tool as defined in claim 19, wherein the tool is adapted to provide a flow of gas flowing in a predetermined direction within the first combustion chamber to discharge gas that has been led into the first chamber together with combustion gas in the first chamber.

25. The combustion power tool as defined in claim 19 further comprising a slide sleeve that moves to open and close bleed holes through which the first combustion chamber can communicate with the outside, wherein the dome shaped partition is integrally formed with the slide sleeve.

26. The combustion power tool as defined in claim 21 further comprising a spherical portion and a spherical recess, wherein the spherical portion is formed in the central region of the dome shaped partition so as to bulge toward the piston and the spherical recess is formed in the top surface of the piston so as to be complementary to the spherical portion.

* * * * *